US006747606B2

(12) United States Patent
Harel et al.

(10) Patent No.: US 6,747,606 B2
(45) Date of Patent: Jun. 8, 2004

(54) SINGLE OR DUAL POLARIZED MOLDED DIPOLE ANTENNA HAVING INTEGRATED FEED STRUCTURE

(75) Inventors: Jean-pierre Harel, Lannion (FR); Eric Deblonde, Mantallot (FR); David Colleter, Lanmeur (FR); Nicolas Cojean, Louanec (FR)

(73) Assignee: Radio Frequency Systems Inc., Meriden, CT (US)

( * ) Notice: Subject to any disclaimer, the term of this patent is extended or adjusted under 35 U.S.C. 154(b) by 32 days.

(21) Appl. No.: 10/157,838

(22) Filed: May 31, 2002

(65) Prior Publication Data

US 2003/0222830 A1 Dec. 4, 2003

(51) Int. Cl.[7] ..... H01Q 9/28
(52) U.S. Cl. ..... 343/808; 343/797
(58) Field of Search ..... 343/808, 797, 343/795, 872, 816, 793, 810, 853

(56) References Cited

U.S. PATENT DOCUMENTS

| | | | | |
|---|---|---|---|---|
| 4,543,583 A | | 9/1985 | Wurdack | 343/792 |
| 4,613,868 A | | 9/1986 | Weiss | 343/700 MS |
| 5,726,666 A | | 3/1998 | Hoover et al. | 343/770 |
| 5,982,336 A | | 11/1999 | Wen et al. | 343/793 |
| 6,028,563 A | | 2/2000 | Higgins | 343/797 |
| 6,034,649 A | * | 3/2000 | Wilson et al. | 343/795 |
| 6,072,439 A | | 6/2000 | Ippolito et al. | 343/797 |
| 6,127,986 A | | 10/2000 | Wen et al. | 343/820 |
| 6,182,157 B1 | | 1/2001 | Schlener et al. | 709/318 |
| 6,253,243 B1 | | 6/2001 | Spencer | 709/224 |
| 6,272,131 B1 | | 8/2001 | Ofek | 370/389 |
| 6,286,040 B1 | | 9/2001 | Durham et al. | 709/221 |
| 6,292,829 B1 | | 9/2001 | Huang et al. | 709/223 |
| 6,298,386 B1 | | 10/2001 | Vahalia et al. | 709/234 |
| 6,300,912 B1 | | 10/2001 | Pla | 343/713 |
| 6,307,510 B1 | | 10/2001 | Taylor et al. | 343/700 MS |
| 6,313,809 B1 | | 11/2001 | Gabriel et al. | 343/797 |
| 6,314,476 B1 | | 11/2001 | Ohara | 710/15 |
| 6,529,172 B2 | * | 3/2003 | Zimmerman | 343/797 |

FOREIGN PATENT DOCUMENTS

EP 0 249 303 A1 12/1987

* cited by examiner

*Primary Examiner*—James Clinger
(74) *Attorney, Agent, or Firm*—Sughrue Mion, PLLC

(57) ABSTRACT

A polarized antenna for sending and receiving polarized radio frequency signals is disclosed which includes a dipole and a reflector plate. The dipole is formed as a single part including the radiating arms and feeding structures, thereby requiring minimum assembly. This dipole can be formed by molding conventional materials, such as copper, aluminum, and plastic, which can then be plated. The feeding structure through which the cable passes features a slotted aperture. The impedance of the dipole is based on the width of these apertures and the size of the cable conductor. By having a single-body construction, the dipole of the present invention provides, good impedance, low intermodulation distortion, good port-to-port isolation, and good pattern purity.

19 Claims, 6 Drawing Sheets

H PLANE RADIATION PATTERN
CO-POLARIZATION & CROSS-POLARIZATION
9 DIPOLES ARRAY
IN MAIN DIRECTION (0°), FROM CO-POLAR TO CROSS-POLAR
-24 dBc AT 1.71 GHz
-23 dBc AT 1.8 GHz
-25 dBc AT 1.88 GHz

OFFSET d'amplitude: 24.22 dB OFFSET de POSITION: 0.03°

SINGLE OR DUAL POLARIZED MOLDED DIPOLE ANTENNA HAVING INTEGRATED FEED STRUCTURE

BACKGROUND OF THE INVENTION

1. Field of the Invention

The present invention generally relates to dual polarized panel base-station antennae for use in mobile communication systems. More specifically, the invention relates to the structure of dipoles used with dual polarized panel base-station antennae.

2. Description of Related Art

Dipole antennae are common in the communications industry, and conventional structures, including half-wavelength dipoles with "bow tie" structures and "butterfly" structures, are described in several books, including *Banalis, Constantine A., "Antenna Theory Analysis and Design"*, Wiley, 1997.

In particular, panel base-station antennae, such as those used in mobile communication systems, rely heavily on dual polarization antennae. In many cases, these antennae are constructed using single linear polarized elements, grouped in such a way that creates dual polarization. In this case, two separate arrays of radiating elements are required to radiate on both polarizations.

Building antenna using this approach is undesirable, however, because creating the dual polarization effect with single linear polarized elements increases the labor cost and the number of parts involved in the antenna's manufacture, while reducing its overall performance. To overcome this, most dual polarization antennae are made with directly dual polarized elements, either by including a single patch element fed in such a manner as to create a dual polarized structure, or by combining two single linear polarized dipoles into one, thereby making a single, dual polarization element.

Feeding signals to and from these dual polarization structures is usually accomplished by conventional coupling structures such as coaxial cables, microstrip or stripline transmission lines, or slits. The drawback to using these conventional coupling structures with the antennae and dipoles described above is that they increase the number of parts needed to construct the antenna, thereby generating undesired intermodulation distortions.

In addition, manufacturing these panel antennae with dipoles that include numerous radiating elements often requires numerous solder joints and screw connections. The total number of parts required in such panel antennae, in addition to the cost of their assembly, makes them unsuitable for mass-production. In addition, solder, screws, and similar types of attachments between parts not only add to the manufacturing time and labor cost, but also generate undesired intermodulation distortions as well.

In addition to avoiding these intermodulation distortions, it is necessary to achieve good port-to-port isolation between the two inputs of the radiating elements in the antenna in order to achieve an efficient communication system. This isolation is the measure of the ratio of power leaving one port and entering the other port. But using the air dielectric transmission lines that are common in conventional coupling structures creates distortions in the signal fed to and from the reflector. In these circumstances, it is prohibitively expensive and difficult to achieve the desired isolation, meaning that the antenna cannot be configured such that one port is used for transmission and the other port for reception.

Finally, in addition to having good port-to-port isolation characteristics and a minimum of intermodulation distortions, it is also important for the dipoles in the antenna array to have a good impedance so that all of the dipoles in the array can be properly matched.

In the view of the above, there is a need in the art for low-cost panel base-station antennae that are easy to assemble, that include a simple arrangement of radiating elements, and require a reduced number of parts and connections. In addition, such antennae must have good port-to-port isolation, good pattern purity, good impedance, and low intermodulation distortion.

SUMMARY OF THE INVENTION

The present invention provides a new and useful single or dual polarized antenna for use in mobile communication systems.

A first embodiment of the invention provides a polarized antenna for use in a mobile communication system comprising at least one dipole having a base portion and a plurality of radiating arms extending therefrom, wherein said dipole is formed as a single structure; and a reflector plate to which the base portion is attached, said reflector plate being a ground plane and reflecting polarized radio frequency signals. The dipole may include two sets of arms, including a first set and a second set respectively having a first polarization and a second polarization corresponding to two polarizations of said dipole. Each set of arms preferably includes two pairs of arms arranged in a V-shape and having a vertex portion. A first pair of arms in each set has a first slot at said vertex portion and a second pair of arms has a second slot at said vertex portion for receiving a feed cable, said first slot receiving a cable center conductor and said second slot receiving an insulating jacket. The dipole can also include a cavity for feeding the cable located at the vertex portion of the arms.

The present invention further provides a method of manufacturing a dipole for use in a polarized antenna, comprising forming an entire dipole body as a single piece, including a base portion and a plurality of radiating arms. The dipole body is optimally molded from a conventional material such as plastic, aluminum or the like. In this case, the method of the present invention further comprises plating the molded dipole body with a metallic material that can be soldered.

Accordingly, the invention comprises the features of construction, combination of elements and arrangement of parts which will be exemplified in the construction hereinafter set forth, and the scope of the invention will be indicated in the claims.

BRIEF DESCRIPTION OF THE DRAWINGS

The objects and advantages of the present invention will be made more clear with reference to the following drawings, in which like elements have been given like reference characters. In particular.

Figure 4:
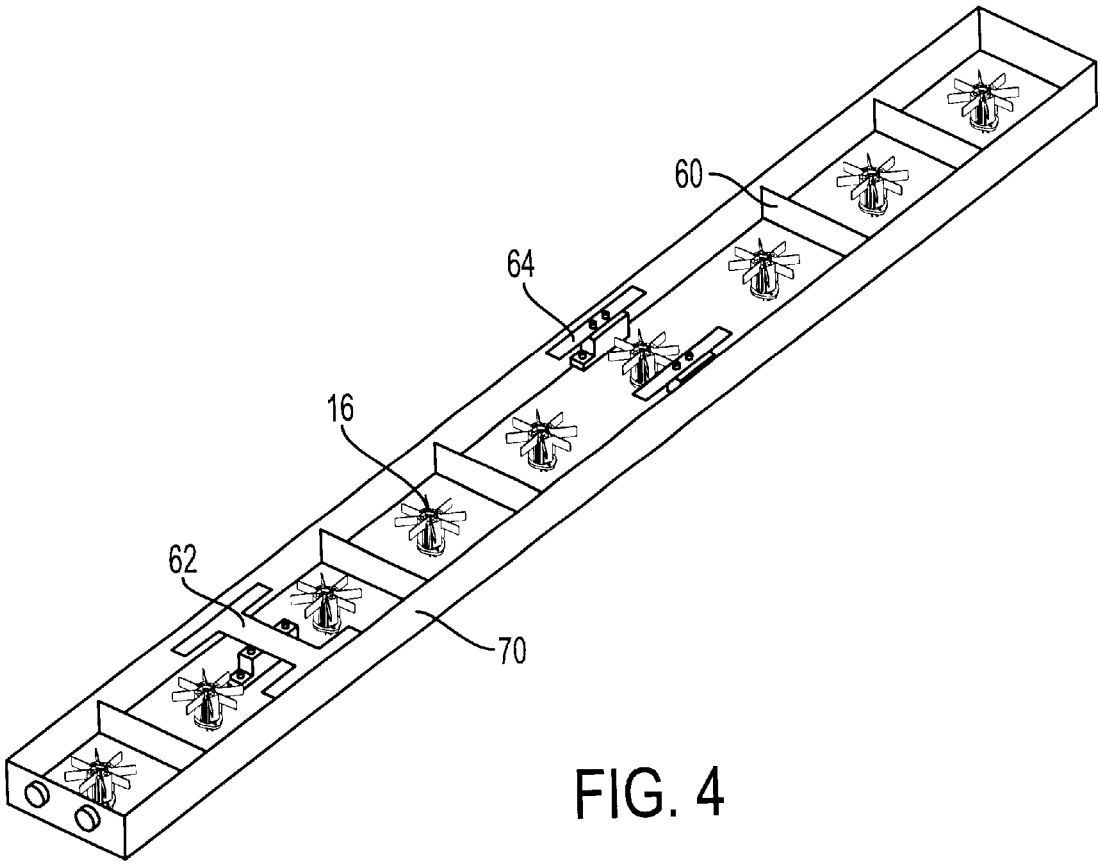
FIG. 4 is a view of an embodiment of an antenna using an array of dipoles having a variety of RF isolation devices.

GHz, 62.2 degrees at 1.8 GHz and 60.5 degrees at 1.88 GHz respectively for a 1*9 antenna array using the subject matter of the invention shown in FIG. 4.

Figure 6:
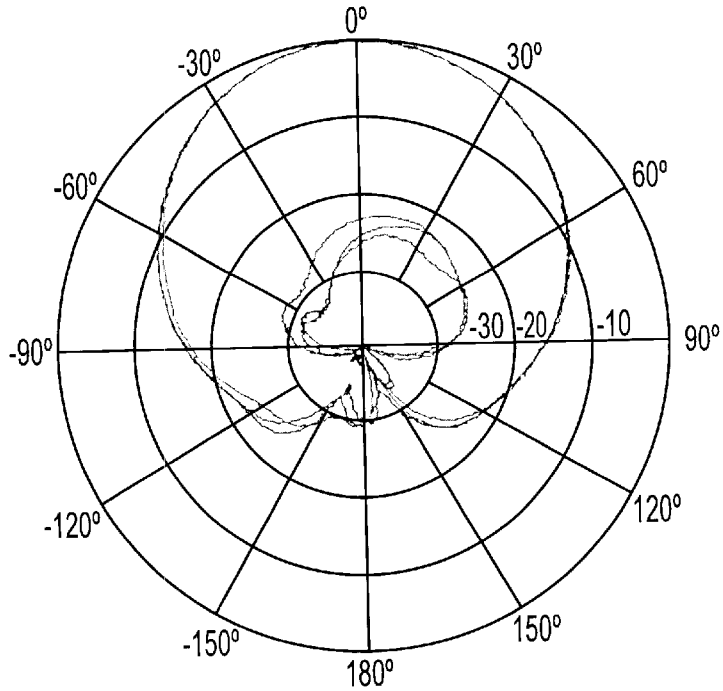

FIG. 6 is a plot of three radiation patterns for the second polarization of a 1*9 arrayed antenna using the subject matter of the invention shown in FIG. 4.

DETAILED DESCRIPTION OF THE PREFERRED EMBODIMENTS

The invention will now be taught using a preferred exemplary embodiment. Although the embodiment is described in detail, it will be appreciated that the invention is not limited to just this embodiment, but has a scope that is significantly broader. The appended claims should be consulted to determine the true scope of the invention.

Figure 1:
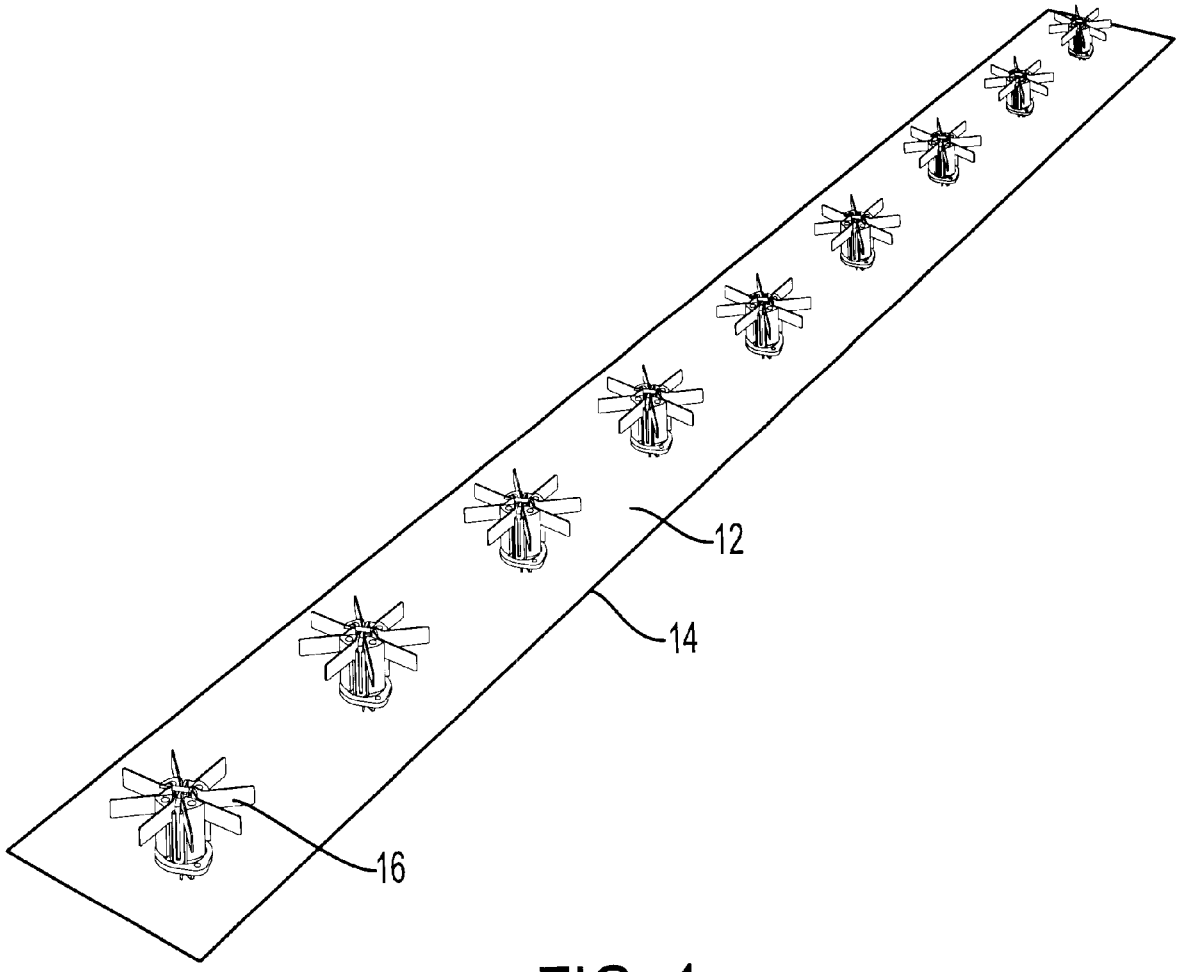
FIG. 1 is a perspective view of an antenna using an array of dipoles.

A preferred embodiment of the invention will now be described with reference to FIGS. 1–6. FIG. 1 shows a dual polarization antenna 14 of the present invention with a 1×9 array of dipoles 16 according to the present invention. The antenna 14 comprises the array of dipoles 16 and a reflector plate 12 to which the dipoles 16 are attached. Of course, it is understood that the invention is not limited to a particular array.

Figure 2:
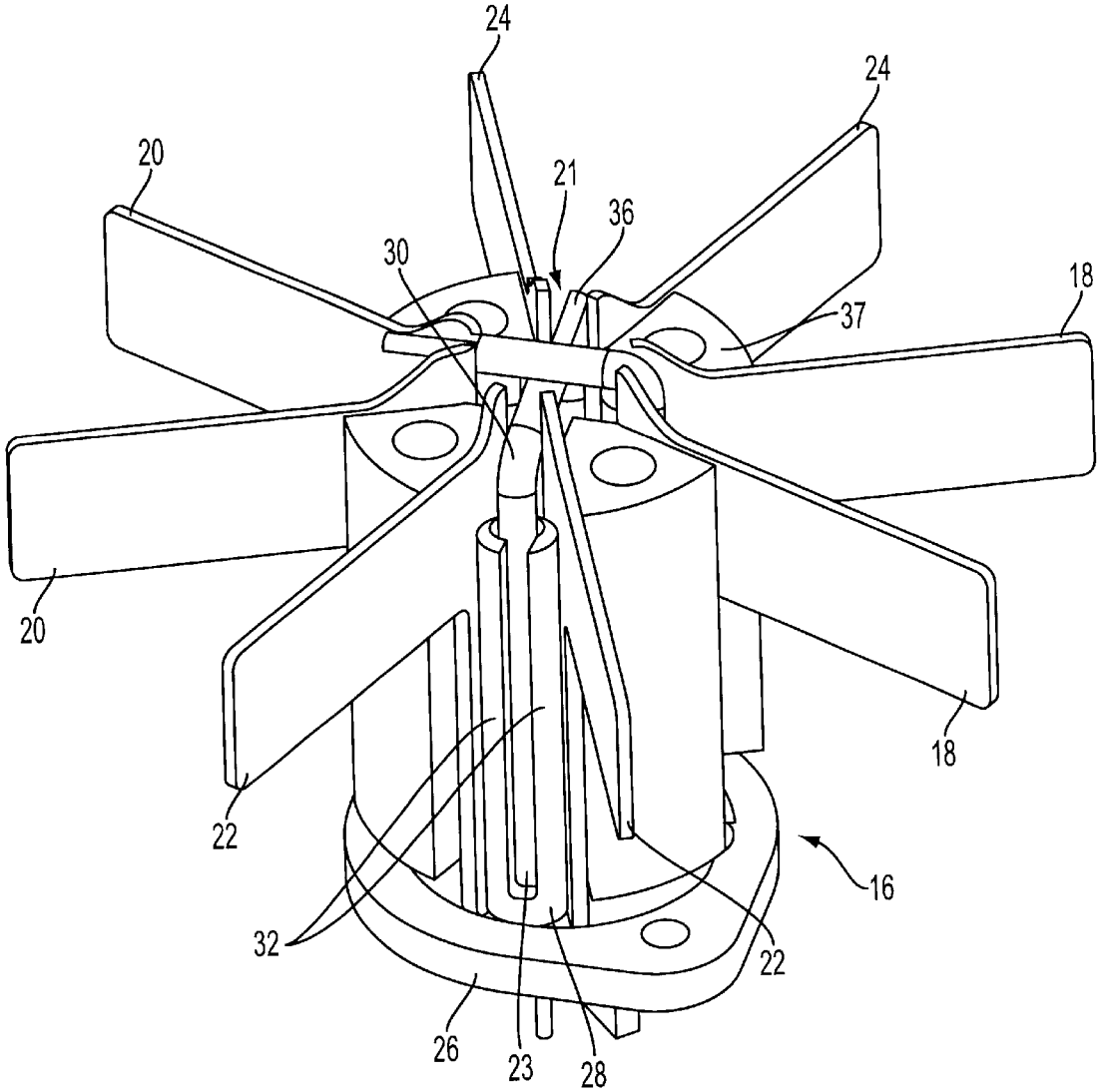
FIG. 2 is a perspective view of the dual polarization dipole (all parts assembled).

FIG. 2 shows a dipole 16 of the present invention in greater detail. The dipole 16 is formed as a unitary structure including the base portion, arms, and feeding structures discussed below. The forming of the dipole can be accomplished by conventional methods, such as molding, casting, or carving. In addition, the dipole can be formed using conventional materials such as copper, bronze, plastic, aluminum, or zamak. If the material used is a type that cannot be soldered, such as plastic or aluminum, then the dipole, once formed, can be covered or plated, in part or in whole, with a metallic material that can be soldered, such as copper, silver, or gold.

The dipole 16 includes four pairs of arms 18, 20, 22, and 24 attached to a base portion 26. The arms are arranged in pairs 18, 20, 22, and 24 each having a V- or U-shape, with the arms radiating outward from the vertex portion 21 of the V or U. The base portion 26 of the dipole attaches to the reflector plate 12 shown in FIG. 1.

The pairs of arms are arranged such that pair 18 is opposite pair 20, and pair 22 is opposite pair 24. The opposing pairs are wired and positioned with respect to the reflector plate 14 so as to transmit and/or receive RF energy at two polarizations: a first polarization of +45 degrees and a second polarization of −45 degrees. Opposing pairs 20 and 18 correspond to the first polarization of the antenna 14. Likewise, opposing pairs 24 and 22 correspond to the second polarization. The dipole of the present invention is not limited to these polarizations, and it is understood that changing the number, arrangement and position of the arm pairs can change both the number of polarizations and the polarization angles of the antenna.

Each set of opposing pairs of arms includes a feeding structure 28 which is located at the vertex portion 21 of one of the arm pairs. This feeding structure 28 is a longitudinal cavity 23 running the length of the dipole body, allowing a cable 30 to be fed into the base portion 26 of the dipole, through the feeding structure, and out to the top of the dipole. A slot, discussed below, is placed in the vertex of the opposite arm pair. The conductor of the cable is soldered to this vertex via this slot.

Figure 3:
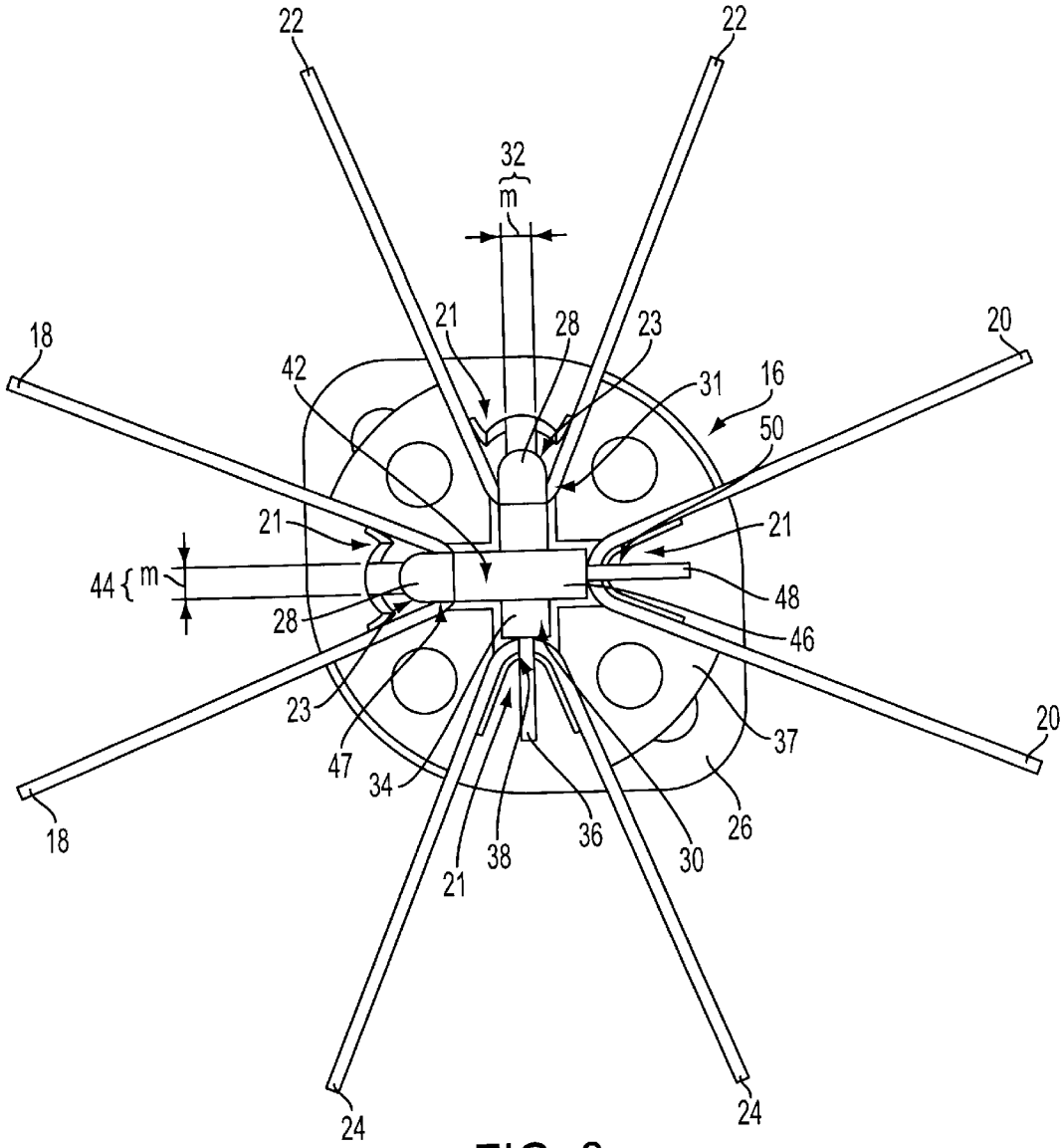
FIG. 3 is a top view of the dual polarization dipole shown in FIG. 2.

FIG. 2 and FIG. 3 show the relationship of these pairs of arms in greater detail. Focusing on a single arm set, including arm pairs 22 and 24, the feeding structure 28 is defined by the cavity 23 that is provided in the vertex portion of one of the arms 22 of the pair. The cable 30 passes through the cavity 23. This feeding structure 28 also includes a slotted aperture 32 that extends along the cavity and has a width m. The slotted aperture 32 exposes the insulating jacket 34 of the cable 30 running through the cavity 23.

Each arm set also includes first and second slots 31 and 38, respectively, through which the cable is further fed. The first slot 31 is located at the vertex portion of a first pair of arms 22 and the second slot 38 is formed at the vertex portion of the second set of arms 24. The cable is run such that the first slot 31 retains the entire cable (i.e., unstripped) and the second slot 38 retains the conductor portion 36 of the cable. The conductor 36 is then soldered to the vertex portion 21 of the second set of arms 24 proximate the second slot 38.

The arm set including arm pairs 18 and 20 is arranged in a similar fashion. The vertex portion 21 of the pair of arms 18 includes a feeding structure 28 through which is defined by the cavity 23, through which a second cable 42 is passed. This feeding structure 28 also includes a slotted aperture 44 that extends along the cavity 23 and has a width m. The slotted aperture 44 exposes the insulating jacket 46 of the cable 42 running through the cavity 23.

Arm sets 18 and 20 also include first and second slots 47 and 50, respectively, through which the cable is further fed. The first slot 47 is located at the vertex portion 21 of the first pair of arms 18 and the second slot 50 is formed at the vertex portion 21 of the second set of arms 20. The cable is run such that the first slot 47 retains the entire cable (i.e., unstripped) and the second slot 50 retains the conductor portion 48 of the cable 42. The conductor 48 is then soldered to the vertex portion 21 of the second set of arms 20 proximate the second slot 50.

An advantage of this dipole structure is that it allows the use of simple coaxial cables to serve as feed cables 30 and 42, as discussed above. These coaxial cables typically include an inner conductor surrounded by an insulator of PTFE or similar material.

Furthermore, the dipole and its internal feeding structure allows these cables 42 and 30 to directly pass through the body of the dipole 16 to the top and connect to the arm pairs 20, 18 and 24, 22 at slots 50 and 38, respectively, without needing any grommets to insulate the conductors 36 and 48 from the conductive base portion 26 to which the arms 20 or 24 are attached. This reduces the overall number of parts needed to build the dipole, thereby lowering the manufacturing cost and improving the RF performance of the antenna.

The signal performance of the dipole 16 can be further improved by placing conventional insulating separators 37 between adjacent arm pairs. These separators can be made of conventional insulating materials such as plastic or PTFE.

Because the impedance of the dipole is determined by the sizes of the apertures, the center conductor of the cable, and the holes in the base portion 26 extending into the cavities 28, these sizes can be chosen to provide the dipole with a desired impedance as well as to facilitate the forming and plating of the dipole. In particular, the size of these apertures can be made wide enough to ensure proper plating of the molded piece, but narrow enough to allow the dipole to provide good port-to-port isolation, good impedance, and good pattern purity. The scope of the invention is not intended to be limited to any particular shape of these apertures.

Specifically, depending on the size m of the apertures in the feeding structure, the characteristic impedance Zo can be readily estimated as follows.

First, in the case where apertures 32 and 44 are closed (where their width m is zero), the impedance, Zo, can be calculated by the following equation:

$$Zo = \frac{60}{\sqrt{\varepsilon r}} \cdot \ln\left[\frac{D}{d}\right],$$

where D is the diameter of the holes in the base portion 26 and the longitudinal cavities 28, d is the diameter of the cable's center conductor, and ∈r is the dielectric constant of the cable insulator used.

In the second case, where the width m of apertures 32 and 44 is very small, the impact of the width on the impedance is negligible. However, if the aperture is slanted at an angle along the length of the feeding structure, then characteristic impedance Zo can be more precisely approximated by the equation:

$$Zo = \frac{60}{\sqrt{\varepsilon r}} \cdot \ln\left[\frac{D}{d}\right] + (0.03\theta^2),$$

where D is the diameter of the holes in the base portion 26 and the longitudinal cavities 28, d is the diameter of the cable's center conductor, θ is the angle at which the aperture is slanted, and ∈r is the dielectric constant of the cable insulator used.

In the third case, where the width m of apertures 32 and 44 is larger, thereby exposing the surface of the cable, then the characteristic impedance Zo can be approximated by the equation:

$$Zo = \frac{60}{\sqrt{\varepsilon r}} \cdot \ln\left[\frac{4h}{d}\right],$$

where h is the radius of the longitudinal cavities, d is the diameter of the cable's center conductor, and ∈r is the dielectric constant of the cable insulator used.

It is understood that the molded dipole of the present invention can be used in a variety of antenna configurations. Furthermore, the base portion 26 of the molded dipole can be designed and shaped to match a complimentary form on the reflector plate 12 so as to further facilitate the assembly of the antenna array. It would be obvious to one skilled in the art that the size and shape of the base portion can vary from antenna to antenna and still be within the scope of the invention.

The present invention also provides for the isolation of inputs of a dipole 16 in antenna arrays that include a plurality of dipoles of the present invention. Dipoles 16 in the dual polarization antenna 14 can be isolated from each other using conventional radio frequency isolation devices, such as walls, H structures and I structures. For example, FIG. 4 shows a dual polarization antenna 70 in which the dipoles 16 are isolated using a number of different isolation devices including walls 60, H isolators 62, and I isolators 64. It is understood that the dipole of the present invention can be used in conjunction with ordinary isolation devices and structures.

Figure 5:
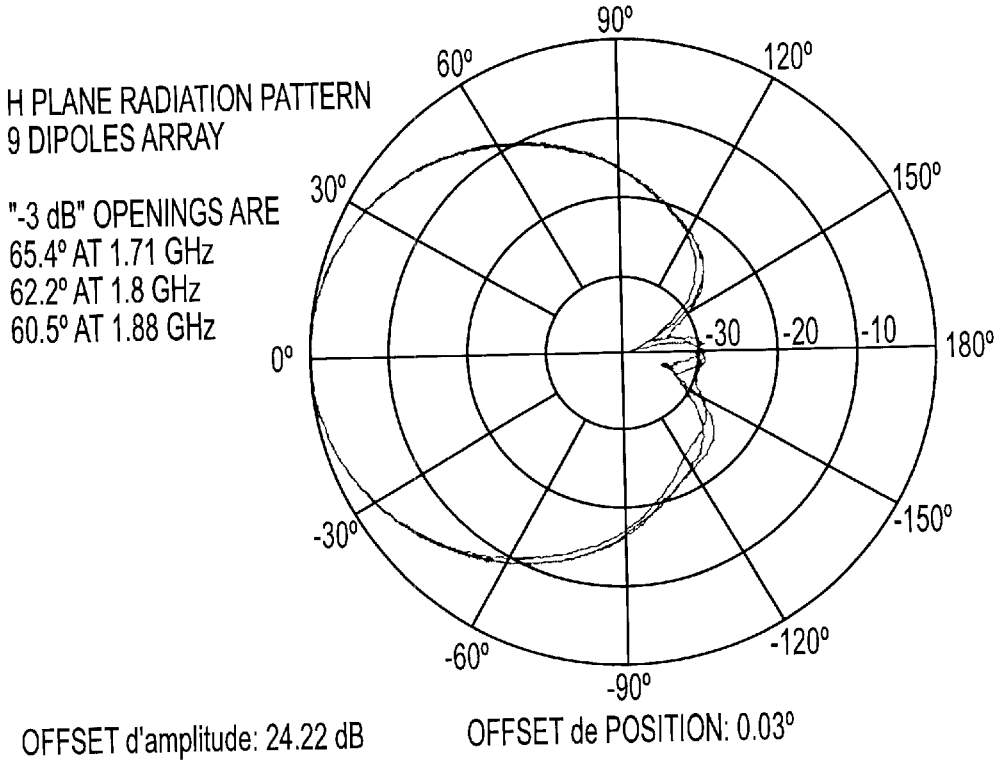
FIG. 5 is a plot of three radiation patterns of the first polarization having beamwidths of 65.4 degrees at 1.71

FIGS. 5–6 show the performance characteristics of the antenna array shown in FIG. 4. FIGS. 5 and 6 show a plot of three radiation patterns of the first and second polarizations of the antenna array of FIG. 4 using dipoles 16 of the present invention. As shown, the antenna exhibits good port-to-port isolation of less than 30 dB at a variety of beamwidths and at high frequencies.

The foregoing description is merely exemplary and is not to be construed in a limiting sense. Modifications will be readily apparent to those of ordinary skill in the art, and are considered to be within the scope of the invention, which is to be limited only by the following claims. For example, although reference is made to arm pairs being V-shaped, it is understood that these arm pairs could also be U-shaped without departing from the spirit of the invention. Indeed, reference to "V-shaped" is intended to include a U-shaped arrangement.

What is claimed is:

1. A polarized antenna comprising:

at least one dipole having a base portion and a plurality of radiating arms extending therefrom, wherein said dipole is a unitary structure; and a reflector plate to which the base portion is attached, said reflector plate being a ground plane and reflecting polarized radio frequency signals;

wherein said plurality of radiating arms are divided into two sets including a first set and a second set respectively having a first polarization and a second polarization corresponding to two polarizations of said dipole body;

wherein each of said first and second sets includes two pairs of arms arrange in a V-shape and having a vertex portion.

2. The antenna of claim 1, wherein said dipole is a molded dipole.

3. The antenna of claim 2, wherein said dipole is made of plastic, aluminum, brass, or zamak.

4. The antenna of claim 3, wherein said dipole is covered at least partially with a plating material that can be soldered.

5. The antenna of claim 1, wherein a first pair of said arms has a first slot at said vertex portion and a second pair of said arms has a second slot at said vertex portion for receiving a feed cable, said first slot receiving a cable center conductor and said second slot receiving an insulating jacket of said feed cable.

6. The antenna of claim 1, wherein said dipole has a feeding structure located therein, said feeding structure having an aperture of width m, and wherein said dipole has a feed hole in said base portion of the dipole through which a feed cable can pass into said feeding structure, said hole having a diameter D, and wherein said cable has a center conductor with a diameter d.

7. The antenna of claim 6 wherein the impedance of the dipole is a function of center conductor diameter d and the diameter D of said feed hole.

8. The antenna of claim 6 wherein said feeding structure has a radius h and the aperture width m is less than the diameter 2 of said feeding structure.

9. The antenna of claim 8 wherein the impedance of the dipole is a function of the center conductor diameter d and the radius h of said feeding structure.

10. The antenna of claim 1 further comprising an insulating separator located between said arms.

11. A method of manufacturing a dipole for use in a polarized antenna, comprising;

forming a dipole body as a single piece, said dipole body having a base portion and a plurality of radiating arms extending therefrom;

wherein said plurality of radiating arms are divided into two sets including a first set and a second set respectively having a first polarization and a second polarization corresponding to two polarizations of said dipole;

wherein each of said first and second sets of arms includes two pairs of arms arranged in a V-shape and having a vertex portion.

12. The antenna of claim 11, wherein said vertex portion of said first set has a first slot and said vertex portion of said second set has a second slot, said second slot being smaller than said first slot.

13. The method of claim 11, wherein said dipole has a feeding structure located therein, said feeding structure having an aperture of width m, and wherein said dipole has a feed hole in said base portion of the dipole through which a feed cable can pass into said feeding structure, said hole having a diameter D, and wherein said cable has a center conductor with a diameter d.

14. The method of manufacturing a dipole of claim 13, wherein said dipole body is molded.

15. The method of manufacturing a dipole of claim 14, wherein said dipole body is molded of plastic, aluminum, or zamak.

16. The method of claim 11, further comprising the step of covering at least part of the molded dipole body with a metallic material.

17. The method of claim 11, further comprising an insulating separator located between said arms.

18. A polarized antenna comprising:

at least one dipole having a base portion and a plurality of radiating arms extending therefrom, wherein said dipole is a unitary structure; and a reflector plate to which the base portion is attached, said reflector plate being a ground plane and reflecting polarized radio frequency signals;

wherein a set of the plurality of arms has a polarization and includes two pairs of arms, each pair of arms arranged in a V-shape and having a vertex portion.

19. The polarized antenna of claim 18, wherein a first pair of said arms has a first slot at said vertex portion and a second pair of said arms has a second slot at said vertex portion for receiving a feed cable, said first slot receiving a cable center conductor and said second slot receiving an insulating jacket of said feed cable.

* * * * *